United States Patent [19]

Kishimoto

[11] 3,960,368

[45] June 1, 1976

[54] HIGH VISCOUS DYEING SIZING MATERIAL PRODUCING MACHINE

[76] Inventor: Tozo Kishimoto, 5, Nishinokyo, Hinokuchi-cho, Nakagyo, Kyoto, Japan

[22] Filed: Nov. 8, 1974

[21] Appl. No.: 522,270

[52] U.S. Cl. ..... 259/10; 259/46; 259/DIG. 18

[51] Int. Cl.[2] ..... B01F 7/04; B01F 15/02

[58] Field of Search ..... 259/9, 10, 45, 46, 68, 259/69, DIG. 18

[56] References Cited

UNITED STATES PATENTS

| | | | |
|---|---|---|---|
| 2,484,070 | 10/1949 | Boyce | 259/45 X |
| 3,145,017 | 8/1964 | Thomas | 259/45 |
| 3,366,368 | 1/1968 | Hibbing | 259/45 |
| 3,570,569 | 3/1971 | Hartley | 259/46 X |

*Primary Examiner*—Robert W. Jenkins
*Assistant Examiner*—Alan Cantor
*Attorney, Agent, or Firm*—Wenderoth, Lind & Ponack

[57] ABSTRACT

A machine for producing a high viscosity dyeing sizing. A sizing boiler is provided in the upper portion of the machine body for boiling an initially provided liquid with steam while agitating it sufficiently with stirring frames, stirring rods and a plurality of blades to produce a high viscosity sizing. The boiler is connected with a cylinder in the lower portion of the machine body, and a piston is movable in the cylinder for sucking the sizing from the size boiler into the cylinder and discharging it therefrom. The piston forces the sizing to pass through a straining screen provided in the front end of the cylinder thereby eliminating impurities and producing a sizing paste of good quality.

5 Claims, 6 Drawing Figures

HIGH VISCOUS DYEING SIZING MATERIAL PRODUCING MACHINE

DETAILED DESCRIPTION OF THE INVENTION

1. Field of the Invention

The present invention relates to a high viscous dyeing sizing producing machine, having in the upper portion of the machine body a sizing boiler for boiling original liquid with steam while agitating liquid sufficiently with stirring frames, stirring rods and a plurality of blades to produce highly viscous sizing, and having a cylinder connected to the bottom of the sizing boiler in the lower portion of the machine body. The sizing in the sizing boiler is sucked into the cylinder, is discharged therefrom by means of the operation of a piston, and is forced through a straining screen provided in front of the cylinder, again by means of the compressing motion of the piston, thereby eliminating impurities and providing a paste of good quality.

2. Description of the Prior Art

Heretofore, to acquire highly viscous dyeing sizing for use with muslin, each fabric of cotton, silk, tetron, nylon, and the like required that the original liquid be made initially with water and starch. The original liquid was then poured into a semicircular sizing boiler and the bottom of the boiler was heated from the outside while the liquid was agitated with a stirring rod to prevent scorching until the liquid became sizing having viscosity by boiling. Because the sizing obtained by this method has impurities, it is poured into a cotton or gauze bag in a given amount and squeezed to eliminate impurities and gain uniformity by removing irregularities. However, the sizing obtained with this process is high in cost. Thereafter, a sizing boiler having several stirring blades rotated mechanically was provided and a paste strainer into which the paste was poured from an inlet port provided at one end of the cylinder and from which the paste was forced by the operation of a piston through a straining screen provided at the other end thereof helped to eliminate impurities, but either of them is individually independent from each other, thus with the former, stirring action cannot prevail all over the interior of the boiler and is not sufficient to avoid the tendency of scorching, and the latter has a drawback requiring much labour to pour-in size.

SUMMARY OF THE INVENTION

In the present invention, steam chambers are provided at the lower half portion of the boiler forming the bottom of the front and rear sides of the boiler shell, and steam is passed through the chambers to heat the original liquid in the sizing boiler. The sizing boiler is also formed by providing a rotary shaft in the boiler shell and attaching stirring frames, stirring rods and a plurality of blades thereto. The sizing boiler is set in the upper portion of the machine body, and a cylinder is set connectedly in the lower portion thereof. The sizing boiled in the size boiler is poured into the rear end of the cylinder and is discharged through a straining screen provided at the front end of the cylinder by operating a piston. This eliminates impurities contained in the sizing, so that highly viscous sizing of good quality may be obtained economically.

Figure 1:
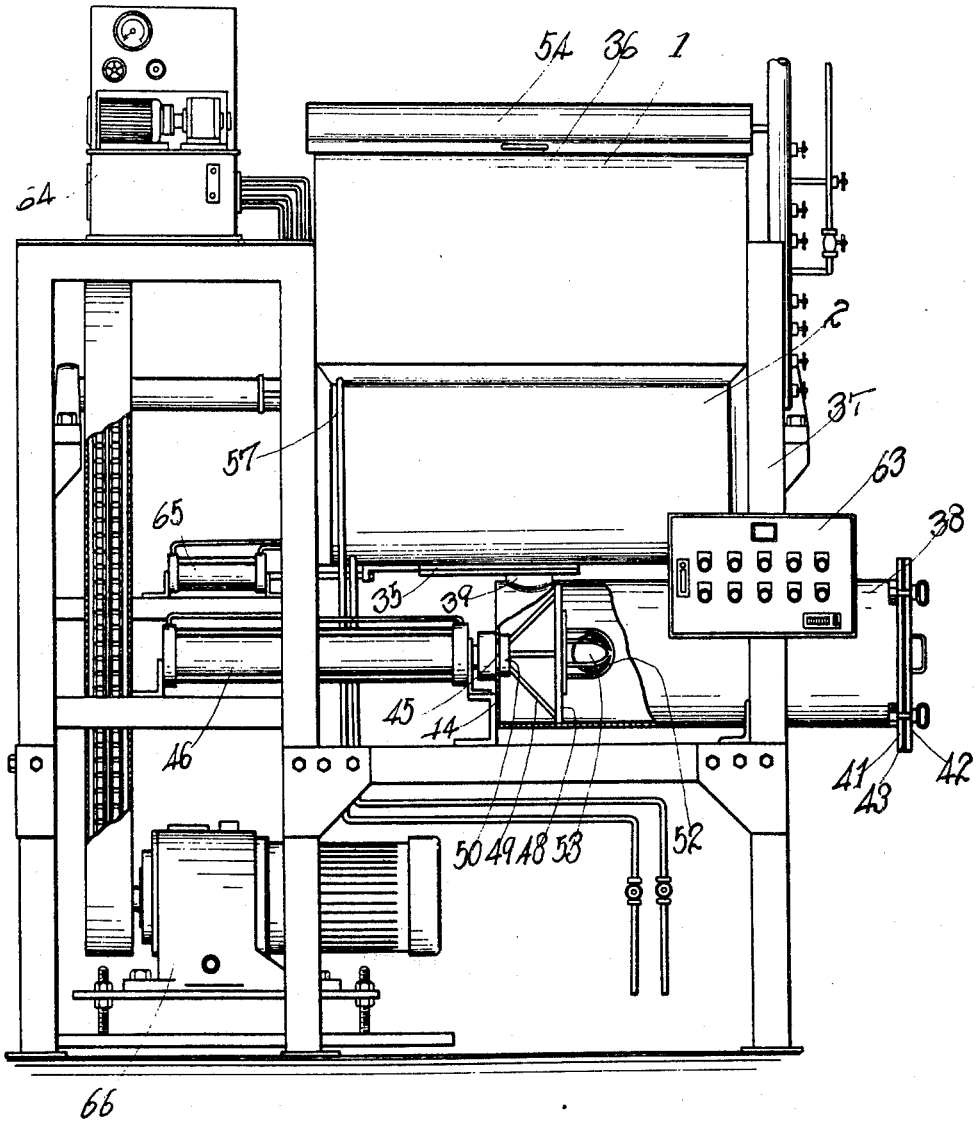
FIG. 1 is a front view of the machine of the present invention.
Figure 2:
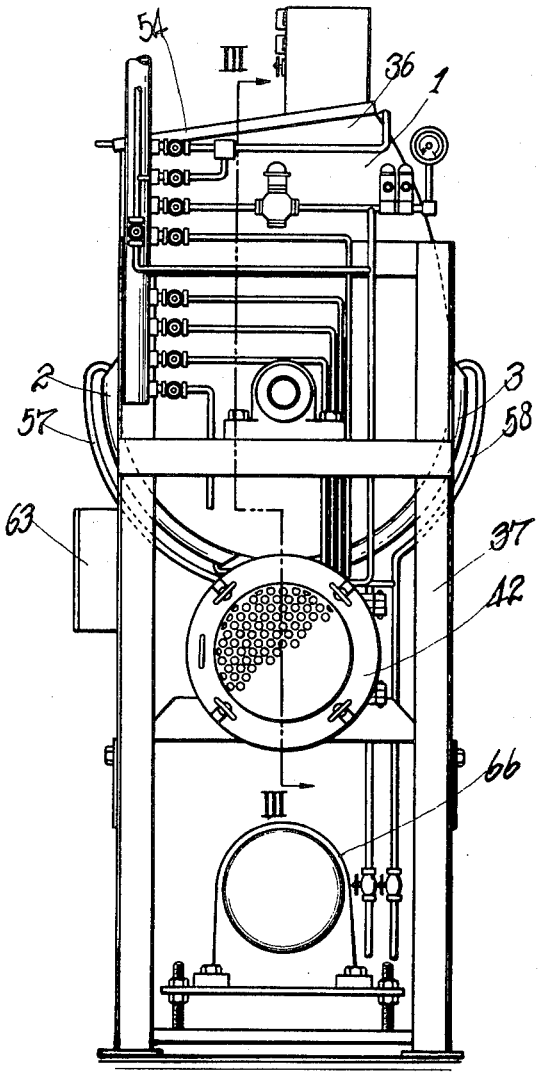
FIG. 2 is a right side view of the same.
Figure 3:
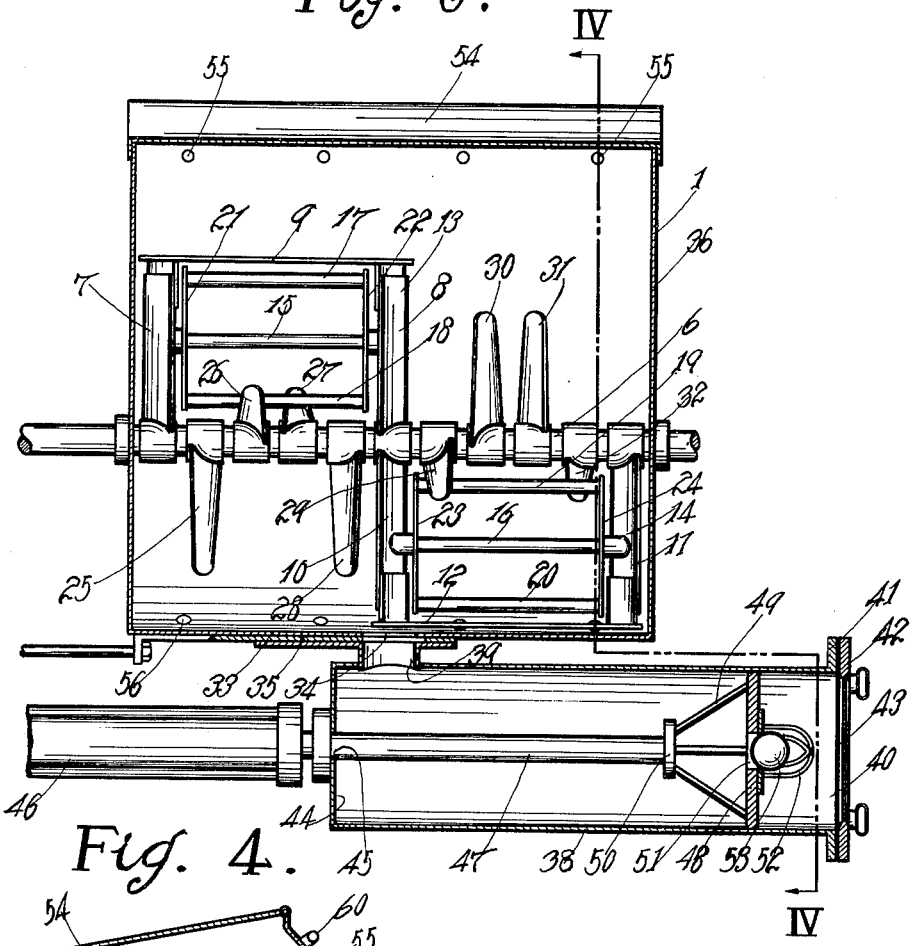
FIG. 3 is an enlarged section taken along the line III—III in FIG. 2.
Figure 4:
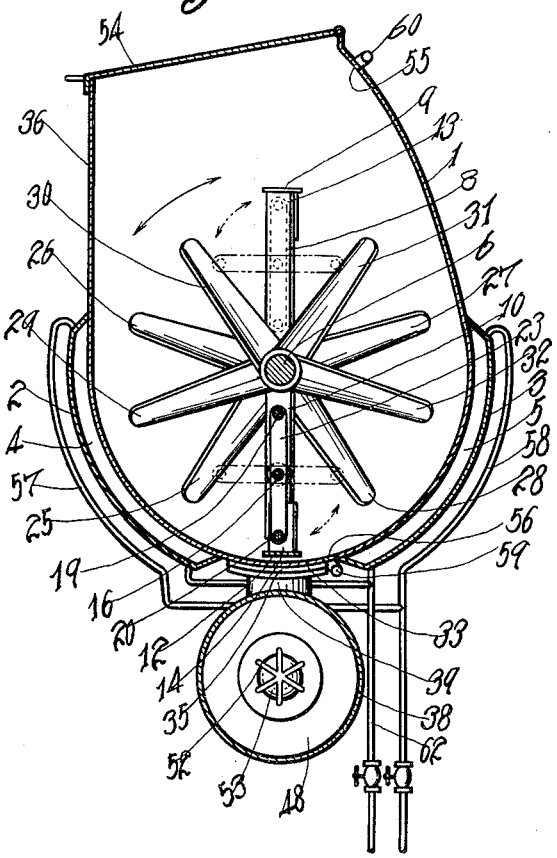
FIG. 4 is a section taken along the line IV—IV in FIG. 3.
Figure 5:
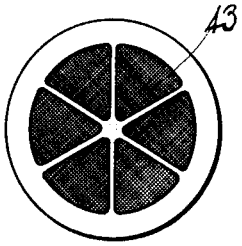
FIG. 5 is a front view of the straining screen.
Figure 6:
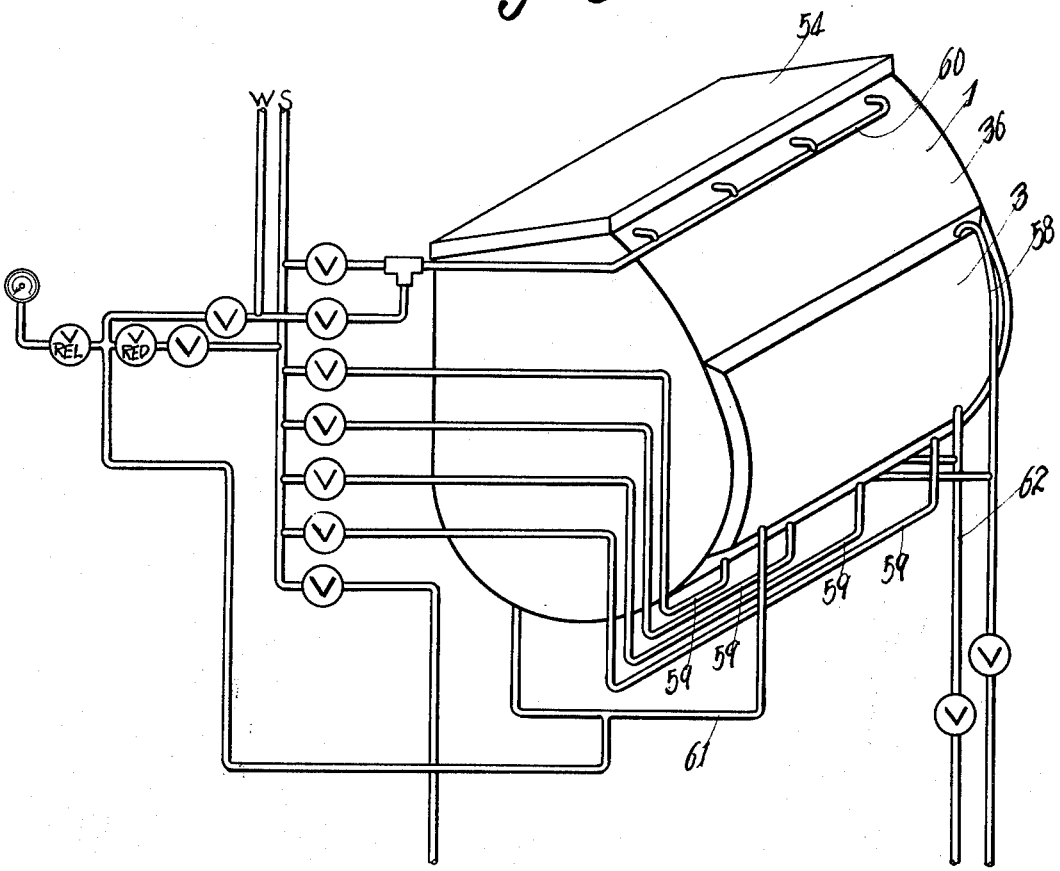
FIG. 6 is an oblique view showing the size boiler and the aspect of the piping thereof.

The present invention will be explained referring to an embodiment thereof as follows, as shown in FIG. 4, steam chambers 4, 5 are formed by welding curved bottom plates 2, 3 along the semicircular shape of the lower half portion of the boiler shell 1 from the middle portions of the shell at the front and rear sides thereof with spaces being provided between the bottom plates 2, 3. A sizing boiler 36 is formed by attaching square-shaped stirring frames 13, 14 comprising respectively frame plates 7, 8, 9 and 10, 11, 12 oppositely to one another on the left and right halves of a rotary shaft 6 mounted horizontally in the central portion in the boiler shell (1), by attaching, rotatably, connecting rods 21, 22; 23, 24 secured with stirring rods 17, 18; 19, 20 at both ends thereof on shafts 15, 16 provided respectively between the frame plates 7, 8 and 10, 11 of the stirring frames 13, 14, and further by attaching slightly obliquely inclined blades 25, 26, 27, 28; 29, 30, 31, 32 each having an attaching angle differing from the other with respect to the stirring frames 13, 14 on the rotary shaft 6 respectively between the frame plates 7, 8 and 10, 11 of the stirring frames 13, 14. A bottom cover 35 is slidably opened and closed on the lower side of a discharging port 34 bored in the central portion of the bottom 33 of the boiler shell 1. The sizing boiler 36 is set in the upper portion of a machine body 37 and a conduit 39 is attached to the upper side at the rear end of a cylinder 38 set adjacent the lower portion of the machine body 37 and is connected to the discharging port 34 of the sizing boiler 36. Between a flange 41 formed outside a discharging port 40 at the front side of the cylinder 38 and a screen cover 42 jointed therewith is sandwiched a straining screen 43, and in the cylinder 38 is inserted a piston rod 47 reciprocated by operating an hydraulic cylinder 46 through a rod hole 45 bored in the middle portion of the side wall 44 of the rear side of the cylinder 38. On the front end of the piston rod 47 is a supporting plate 50 supporting collectively four supporting rods 49 which in turn support the piston 48. A ball receiving frame 52 is provided outside a discharging port 51 bored in the middle portion of the piston 48, and a ball 53 is fitted into the ball receiving frame 52 to make the discharging port 51 freely openable and closable. The drawings further disclose a boiler cover 54, a water supply port 55, a steam port 56, steam feed pipes 57, 58, 59, water feed pipes 60, 61, a drain pipe 62, a change-over electromagnetic valve 63, an hydraulic pump 64, an hydraulic cylinder 65, and an electric motor 66.

The present invention comprises a construction as stated above. To produce highly viscous sizing with a machine according to the present invention, initially a proper quantity of starch is thrown into the boiler shell 1, and after having supplied a rate of water suitable for the given density through the water supply pipe 60, the boiler cover 54 is closed, and the rotary shaft 6 mounted horizontally in the central portion of the boiler shell 1 is rotated. At this time, the stirring frames 13, 14, stirring rods 17, 18; 19, 20 and blades 25, 26, 27, 28; 29, 30, 31, 32, attached to the rotary shaft 6 start simultaneously to agitate. Then the starch is dissolved in the water by the agitation power, thereby constituting the original liquid. Steam is then fed into the boiler shell 1 through the steam feed pipe 59 to boil the original liquid, and simultaneously additional steam is fed into the steam chambers 4, 5 through the steam feed pipes 57, 58. That additional steam is not contacted directly to the original liquid in the boiler shell 1, but heats the bottom thereof from the front and rear shell portions and quickly changes the original liquid in the boiler shell 1 into sizing. Thus, when the original liquid is heated to boiling for a given time period from the outside and inside of the boiler shell 1 while being agitated, the viscosity is increased gradually and highly viscous sizing may be obtained. When the paste required is obtained, the steam fed through the steam feed pipe 59 is stopped, and only the steam heat in the chambers 4, 5 is left remaining. Thereupon when the first push button of the changeover electromagnetic valve 63 is pushed, the working oil is pressed into the hydraulic cylinder 65 by the hydraulic pump 64, and the piston rod 47 is started, and thereby the bottom cover 35 of the boiler shell 1 is opened. When the second push button is pushed, as before, the working oil enters the hydraulic cylinder 46 and the piston rod 47 advances and presses the piston 48 forward in the cylinder 38. With this operation, the rear side of the piston 48, that is, the interior of the space at the rear end of the cylinder 38 is vacuumized, and the sizing in the sizing boiler 1 is sucked and flows into the cylinder 38 through the discharging port 34 and the conduit 39. When the third push button is pushed, the bottom cover 35 closes, and the piston 48 in the cylinder 38 returns rearward by pushing the fourth push button, whereupon the ball 53 in the ball receiving frame 52 is moved by the pressure of the paste having flowed into the cylinder 38 and the discharging port 51 is opened. The paste is transferred to the front of the piston 48 by passing through the discharging port 51 when the piston 48 returns back toward the side wall 44 at the rear side. By pushing the first button again the operation as before is repeated; namely, when the piston 48 advances, the paste moves to the front of the piston 48 and, as the ball 53 in the ball receiving frame 52 closes the discharging port 51 opposite to before, and the paste also presses and passes through the straining screen in front and further discharges outside through the screen cover 42. By repeating this process, the required highly viscous sizing may be obtained. And other push buttons provided in the change-over electromagnetic valve 63 are to operate other machines.

The reason the stirring frames 13, 14 provided in the size boiler 36 in the present invention are mounted respectively on the left and right halves of the rotary shaft 6 opposite to one another, the frame plates 7, 8; 10, 11 are attached slightly obliquely, the stirring rods 17, 18, 19, 20 are made reversible, and the blades 25, 26, 27, 28; 29, 30, 31, 32 are slanted while being attached to the stirring frames 13, 14 with an angle differing from each other with respect to the stirring frames 13, 14, is to provide uniformity and strengthen the agitating power inside the boiler shell 1. The mesh used in the straining screen 43 provided in front of the cylinder 38 is 80 to 180, and the mesh of the screen 42 is a size of 10 mm. Accordingly, the paste after having passed through the straining screen 43 is discharged outside through the screen cover 42 serving as supporting plate. To clean the residues of impurities remaining in the cylinder 38, when the screen cover 42 and the straining screen 43 are removed by unscrewing the set-screws in front of the cylinder 38, and the interior of the cylinder is exposed, so that it may be cleaned freely. Also the straining screen 43 may be replaced with that of different mesh. Thus, the present invention can produce efficiently highly viscous sizing and also mechanically that of good quality unformalized.

What we claim is:

1. An apparatus connnected to a steam source for producing highly viscous dyeing sizing from starch solutions, said apparatus comprising:

boiling means for mixing together, heating, and steam boiling said starch solutions into sizing paste, said boiler means having a plurality of steam inlets through the lower portion thereof connected to said steam source and also have a first discharge port through the bottom thereof;

stirring means within said boiler means for stirring said starch solution inside said boiler means;

slidable cover means fitted over said first discharge port for opening and closing said discharge port;

cylinder means positioned beneath and connected at the rear thereof to said first discharge means for receiving the steam boiled sizing paste mixture discharged from the boiler means through said first discharge port;

straining screening means in the end of said cylinder means opposite the end connected to said first discharge port for straining therethrough the sizing paste contained in said cylinder means, whereby the mixture is strained to a uniform consistency;

hydraulic piston means reciprocally movable within said cylinder means for forcing said sizing paste in said cylinder means through said screening means, said piston means further having a second discharge port therethrough; and valve means positioned over said second discharge port for controlling the flow of sizing paste through said second discharge port in said piston means in relation to the direction of movement of the piston means, whereby movement of the piston means toward said screening means causes said valve means to close, thereby forcing all of the sizing mixture between said piston means and said screening means outward through said screening means, and whereby withdrawing said piston means from the screening means causes said valve means to open and causes the sizing paste drawn into the cylinder means through said first discharge port during the forcing of the sizing mixture through said screening means to flow from one side of said piston means to the other side of said piston means through said second discharge port.

2. An apparatus as claimed in claim 1, wherein said boiler means is comprised of:

a boiler shell with a semicircular lower portion, said semicircular lower portion having said steam openings directed thereinto; and a plurality of steam chambers connected to said steam source and fixed to the outside of said semicircular surface for heating the lower portion of said boiler shell and the contents contained therewithin.

3. An apparatus as claimed in claim 1, wherein said stirring means is comprised of:

a rotary shaft longitudinally mounted through said boiler means;

at least one pair of stirring frames, each frame mounted on one-half of said rotary shaft in a direction opposite the direction of the other frame of said pair of frames;

a longitudinal shaft mounted in each stirring frame parallel to said rotary shaft;

a plurality of rotatable stirring rods operatively connected parallel to said longitudinal shaft for rotation thereabout; and a plurality of stirring blades connected to said rotary shaft at an oblique angle to the axis of said shaft and directed outward from said rotary shaft at angles to said stirring frames.

4. An apparatus as claimed in claim 1 wherein said hydraulic piston means is comprised of:

a hydraulic cylinder outside said cylinder means axially aligned with the axis of said cylinder means and located at the end of said cylinder means opposite said screening means;

a movable piston rod positioned within said cylinder means and extending outward through the rear of said cylinder means and fitted in said hydraulic cylinder; and a piston fitted to the end of said piston rod opposite the end fitted into said hydraulic cylinder, said piston having said second discharge opening therethrough.

5. An apparatus as claimed in claim 1 wherein said valve means is comprised of:

a cage fitted over said second discharge port through said piston means; and a ball larger in diameter than said second discharge port loosely fitted within said cage, whereby moving said piston means towards said screening means causes said loosely fitted ball to lodge in said second discharge port, thereby prohibiting the flow of starch paste through said second discharge port, and whereby withdrawing said piston means from said screening means forces said ball away from said second discharge port, thereby allowing said starch paste to pass through said second discharge port.

* * * * *